United States Patent [19]

Krause

[11] Patent Number: 4,623,763

[45] Date of Patent: Nov. 18, 1986

[54] ROTARY MULTI-CONTACT SWITCH

[75] Inventor: W. Barry Krause, Spotsylvania, Va.

[73] Assignee: Oslo Controls, Inc., Cheshire, Conn.

[21] Appl. No.: 762,782

[22] Filed: Aug. 6, 1985

[51] Int. Cl.[4] ..... H01H 1/16; H01H 19/54; H01H 21/76

[52] U.S. Cl. ..... 200/11 K; 200/277

[58] Field of Search ..... 200/11 R, 11 A, 11 C, 200/11 G, 11 J, 11 K, 11 E, 11 EA, 11 H, 155 R, 155 A, 277

[56] References Cited

U.S. PATENT DOCUMENTS

| | | | |
|---|---|---|---|
| 2,459,998 | 1/1949 | Ellithorpe | 200/6 BB |
| 3,102,173 | 8/1963 | Damon | 200/11 H |
| 3,183,316 | 5/1965 | Roeser | 200/11 K |
| 3,261,930 | 7/1966 | Sorenson | 200/11 G |
| 3,294,929 | 12/1966 | Johnson | 200/11 J |
| 3,311,718 | 3/1967 | Allison et al. | 200/11 K |
| 3,639,708 | 2/1972 | Wolniak et al. | 200/11 K X |
| 3,970,986 | 7/1976 | Seyler et al. | 338/171 |
| 3,996,440 | 12/1976 | Niconienko | 200/155 A |
| 4,258,237 | 3/1981 | Beck | 200/11 J |
| 4,558,193 | 12/1985 | Test | 200/11 R |

*Primary Examiner*—J. R. Scott

*Attorney, Agent, or Firm*—Banner, Birch, McKie & Beckett

[57] ABSTRACT

A rotary switch having a housing carrying a plurality of terminals which may be assembled within the housing in various combinations to give the switch different operating characteristics, with the terminals providing a circular array of spaced switch contacts arranged in a plane normal to the switch axis, has a rotary carrier mounting at least one disc contactor facing the array of contacts, the carrier being biased toward the plane of the contacts to urge the contactor into circuit closing relation with the contacts. A switch base snaps together with the terminal housing to enclose the carrier and an actuator, preferably in the form of a key lock tumbler plug, extends through the base and drivingly engages with the carrier to effect rotation of the contractor relative to the contacts and thereby operate the switch.

12 Claims, 6 Drawing Figures

ROTARY MULTI-CONTACT SWITCH

FIELD OF THE INVENTION

This invention relates generally to the switch art and, more particularly, to a rotary switch provided with a plurality of terminals having the same or different configurations which may be assembled within the switch in various combinations to give the switch different operating characteristics.

BACKGROUND OF THE INVENTION

With the advent of minaturized electronic components, the need for smaller, while at the same time less expensive, switches has become increasingly important. Minaturization of electrical and electronic circuits have substantially decreased the cost involved because of simplicification of the equipment involved. On the other hand, switches have become difficult to produce in minaturized form largely because of the intricacy of the dyes and tools required as well as the greater cost in either the skilled labor needed or in the complex automated machinery required.

Rotary switches have long been used to make and break an electrical connection in electrical circuits, the achievement of this electrical connection generally being dependent upon the mechanical interaction of the component part of the switch. In switches utilizing rotary movement, mechanical contact creating the electrical connection between two electrical terminals is often obtained by rolling members such as conductive balls, rollers or other curved members conducive to the rotation of this switch. Rolling contacts in a rotary type switch are used mainly because they respond to rotational movement with reduced, if not minimum, friction resulting in less wear of the component parts of the switch.

A desirable feature for rotary switches is to maintain the circuitry of the switch fixed in a set position once that position has been selected for the switch. In order to prevent inadvertent drifting of the switch out of this selected position, some prior art arrangements have employed detent mechanisms, contributing an added complexity to the switch construction. Generally, the function of these mechanisms is to develop a restraining force between interacting mechanical members, one of which is movable with respect to the other, such that the movable member is selectively locked in a fixed position. This stopping action is selective since the mechanism is arranged to allow the movable member to advance out of one position and into the next position when additional force is applied to overcome the original restraining force. Most prior art devices utilizing detent mechanisms couple these locking mechanisms to the contact means to thereby index the stopping action such that a fixed position coincides with a make or break electrical connection being made.

The interdependence of the contact means and the detent mechanism and, consequently, the need to use more parts has inherently resulted in switches being too large in size for many minaturized applications. While these switches may be mounted on printed circuit boards, the switches are frequently mounted to a panel with either soldered wire leads or fast-on wire tab connectors.

SUMMARY OF THE INVENTION

A principle object of the present invention is to provide a rotary switch which is simple and compact in design having the capability for easy assembly of its component parts utilizing automated assembly techniques.

A further primary object of the instant invention is to provide a rotary switch wherein the component parts are capable of being fully assembled by moving the parts in a single axial direction whereby they are assembled into an integrated switch assembly without the need for utilization of special tools or specialized assembly equipment or secondary operations such as staking, riveting, heat joining parts, etc.

A further object of the invention is to provide a rotary multicontact switch incorporating a plurality of terminals having the same or differing configurations, such terminals being capable of assembly within the switch housing in various combinations to give the switch different operating characteristics.

The rotary switch invention herein achieves the above mentioned object, aims and purposes by the switch having a housing carrying a plurality of terminals which may be assembled within the housing in various combinations to give the switch different operating characteristics. These terminals may be single width or double width; all single width terminals may be assembled within the housing; all double width terminals may be assembled; or a mix of single and double width terminals may be assembled. The different combinations of these terminals serves to give the rotary switch different operating characteristics.

The terminal housing has an external wall defining a generally cylindrical cavity interiorly of the wall with a series of openings formed in the wall circumferentially spaced relative to the cavity, these openings extending generally parallel to the axis of the cavity. Each switch terminal has a terminal portion extending through one of the openings with its end exposed exteriorly of the housing for connection of the switch into a circuit to be controlled. Further, each terminal has a contact portion disposed generally parallel with the bottom of the cavity normal to the axis of the cavity.

A carrier is rotatably fitted within the terminal housing cavity, this carrier having at least one pocket and preferably two pockets disposed on diametrically opposite sides of the cavity axis with the pocket or pockets facing the bottom of the cavity. A disk contactor is loosely received within each pocket to be freely movable therewithin.

A base provided with resiliently yieldable fingers having hooks at the free ends of these fingers engage over the exterior of the terminal housing such that the base snaps together with the terminal housing to enclose the carrier and disk contactor within the cavity. A curved spring of flat resilient material is disposed between the base and the carrier to urge the carrier and the disk contactor toward the contact portions of the terminals.

An actuator, preferably in the form of a key lock tumbler plug, extends through the base and drivingly engages with the carrier located within the cavity to effect rotation of the disc contactor relative to the contact portions and thereby operate the switch.

BRIEF DESCRIPTION OF THE DRAWINGS

The foregoing objects, as well as others, will become apparent through consideration of the following detailed description of the invention given in conjunction with the accompanying illustration on the drawings in which.

DETAILED DESCRIPTION OF A PREFERRED EMBODIMENT

Figures 1, 1A:
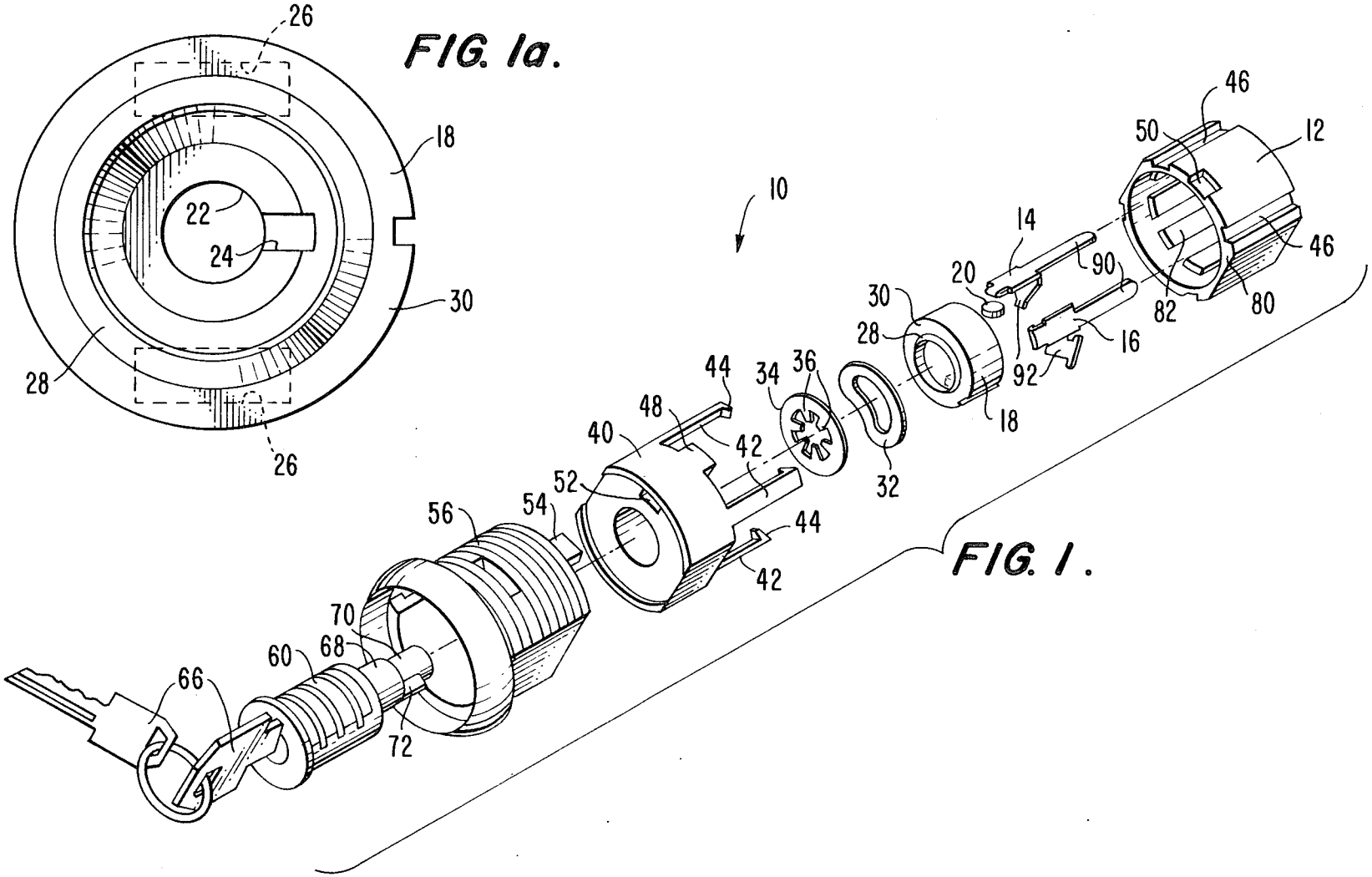
FIG. 1 is an exploded perspective view of the rotary switch of this invention illustrated with a key lock tumbler plug forming the switch actuator.
FIG. 1*a* is an end view of the carrier for the disk contactors.
Figure 2:
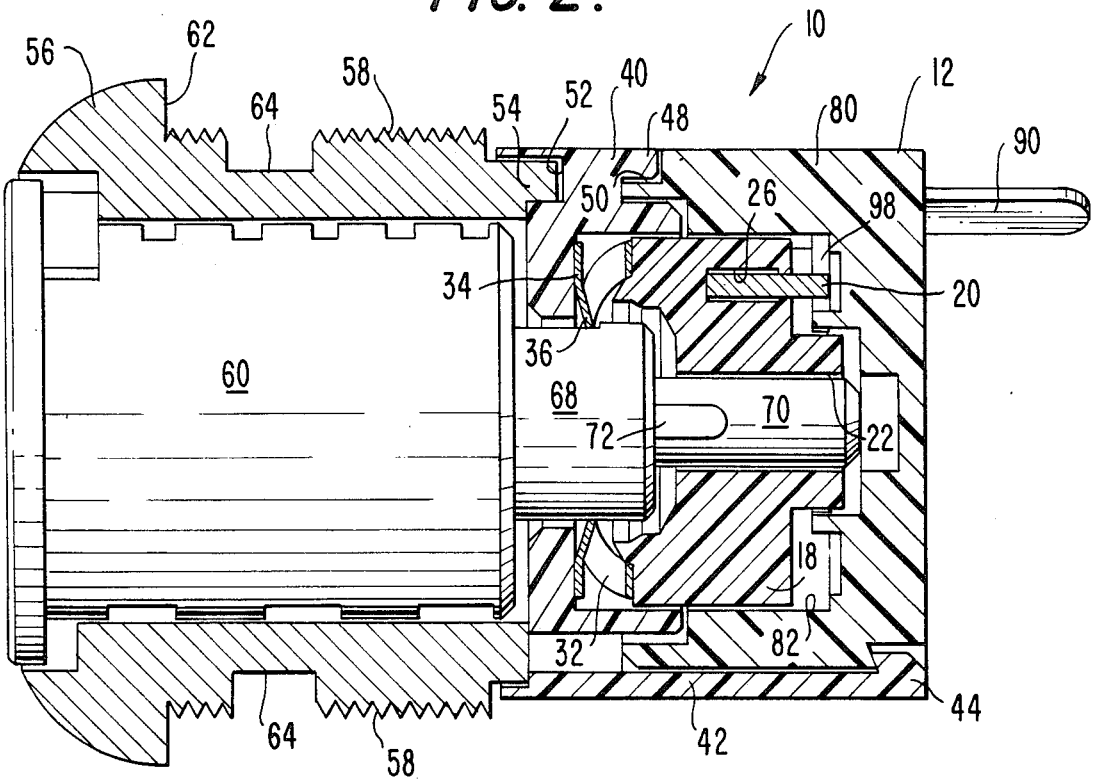
FIG. 2 is a sectional view of the assembled rotary switch of this invention taken generally on line 2—2 of FIG. 3 which shows the terminal housing with terminals mounted therein.

FIG. 1 shows the rotary switch 10 with its component parts in exploded relation to one another while FIG. 2 shows a section through the fully assembled rotary switch 10. It will be noted that the section shown in FIG. 2 is not a diametrical half section of the switch, but rather follows the section line 2—2 shown on FIG. 3, this latter Figure illustrating the terminal housing 12 which carries a plurality of the terminals 14 and/or 16.

While the details of the terminal housing 12 and terminals 14 and 16 will be more extensively described subsequently, it may be noted at this point that the plurality of terminals 14 and/or 16 may be assembled within the housing 12 in various combinations to give the rotary switch 10 different operating characteristics. For example, where all single terminals 14 are mounted at the eight terminal locations in the switch configuration for terminal housing 12 as illustrated on the drawings, the rotary switch detents every 45°. On the other hand, where the rotary switch 10 is assembled with four double terminals 16, these double terminals being mounted in four of the eight positions on terminal housing 12, the rotary switch detents every 90° of switch actuator rotation. Various combinations of single terminals 14 and double terminals 16 may be employed to obtain other switch operating characteristics. For example, on FIG. 3 the terminal housing 12 is shown with one double terminal 16 and two single terminals 14 mounted on either side of the double terminal 16.

A cylindrical carrier 18 loosely mounts a disk contactor 20. As best shown in FIG. 1*a* the cylindrical carrier 18 has a central bore 22 provided with a keyway 24. This bore 22 and keyway 24 receive the shaft and key on the shaft, respectively, of the switch actuator which will be described hereinafter, such actuator enabling rotation of the carrier 18 and contactor disc 20 to rotate the contactor disc relative to the contact portions of the terminals 14 and/or 16 carried by terminal housing 12.

As shown on FIG. 1*a*, the cylindrical carrier 18 is provided with two pockets 26 that are rectangular in cross-section. A disc contactor 20 is loosely received within each of pockets 26 to be freely movable therewithin during operation of the rotary switch 10.

The cylindrical carrier 18 is provided with an annular conical projection 28 at one end thereof leaving a flat annular wall portion 30 extending radially outwardly from the conical projection 28. A circular curved spring 32 formed from flat resilient material such as steel spring stock overlies the annular flat wall portion 30 of cylindrical carrier 18. In assembly of the rotary switch 10 component parts, the annular conical projection 28 serves to effectively center the circular curved spring 32 for it to rest against the annual flat wall portion 30 of carrier 18.

As will be more apparent from the description given hereinafter, the circular curved spring 32 serves to urge the carrier 18 and the disc contactors 20 carried thereby toward the contact portions of the terminals 14 and/or 16 mounted within terminal housing 12. While a circular curved spring 32 is specifically illustrated, it will be understood that other spring means such as a coil spring could be used in place of the circular curved spring 32.

A push on fastener 34 having a central aperture with a series of radially inwardly projecting teeth 36 which may be made of high carbon spring steel provides a continuous annular surface for the circular curved spring 32 to ride on as the rotary switch is operated. The radially inwardly projecting teeth 36 bend away from the plane of push on fastener 34 when the component parts of the switch 10 are being assembled, namely, when the cylindrical sleeve portion of the switch actuator surrounding the actuator shaft and key carried by the shaft is pressed through the central aperture deflecting the teeth 36 so that they bite into the cylindrical sleeve portion thereby firmly and securely holding the actuator onto the basic switch components as will be described hereinafter.

A base 40 provided with connecting means cooperable with the housing 12 to connect base 40 and housing 12 together completes the active switching component parts. This connecting means on base 40 is provided by four resiliently yieldable fingers 42. Each finger 42 has an inwardly facing hook 44 on the outer end thereof.

The base 40, as well as carrier 18 and terminal housing 12, may be easily molded of a plastic material, not only an advantage for ease of construction of the parts but also providing the required electrical insulation characteristics for the switch. Further, in molding the base 40 with its fingers 42 and hooks 44, the desired resilient yieldibility of the fingers 42 is inherently provided by the plastic material used in molding base 40.

The terminal housing 12 is provided with four grooves 46 circumferentially spaced around the outer surface of the exterior wall of housing 12. These grooves 46 are parallel to the axis of the cavity within housing 12 that receives the cylindrical carrier 18.

Thus, in snapping together the component parts of the rotary switch 10 to enclose carrier 18 within the cavity of terminal housing 12 the resiliently yieldable fingers 42 on base 40 are sprung outwardly as they ride down the grooves 46 of housing 12 until the hooks 44 on fingers 42 snap over the exterior of the terminal housing to hook beneath the end of the exterior wall of terminal housing 12.

To ensure proper orientation in connecting together the terminal housing 12 and base 40, base 40 is provided with an alignment tab 48. Likewise, the open end of terminal housing 12 is provided with an alignment notch 50 which receives the tab 48 when the housing 12 and base 40 are snapped together in their final assembled relationship.

On the opposite end of base 40 from alignment tab 48 a pocket 52 is provided. This pocket receives the projection 54 on the shell 56 that carries the key lock tumbler plug 60.

As may be seen from the sectional view of FIG. 2, the projection 54 fits into the pocket 52 to maintain proper alignment between the shell 56 and base 40. Similarly, the alignment tab 48 is received in the notch 50 of housing 12 to assure proper orientation between housing 12 and base 40.

The shell 56 for the key lock tumbler plug 60 has exterior threads 58 provided thereon. Thus, the entire rotary switch 10 may be easily mounted in an opening provided on a panel mount (not shown) by the entire switch being inserted through the opening until the flange 62 on shell 56 engages flush against the panel mount surface. Then an annular nut (not shown) may be threaded over threads 58 from the back of the panel mount to securely mount the rotary switch 10 on the panel.

While the panel mount opening may be circular, it is preferred that the opening be shaped to be circular at its top and bottom with straight parallel sides joining these circular portions. Thus, the opening will have the shape of the shell 56 as shown on FIG. 1. Then, when the switch is inserted through this shaped opening, it is assured that the switch 10 is oriented properly in the panel mount so as not to rotate when turned or when the annular nut is installed on the back of the panel mount.

Alternatively, a spring clip (not shown) may be applied, this clip entering within the groove 64 formed on the exterior of shell 56. In this form of mounting, again the rotary switch 10 is inserted completely through the panel mount until the flange 62 engages flush against the exterior surface of the panel mount. Thereafter, the spring clip (not shown) is inserted through the groove 64, the clip thereby acting to retain the switch 10 on the panel mount.

The key lock tumbler plug 60 may be of any conventional commercially available form. A five tumbler lock provided with conventional keys 66 offering switch locking capability is illustrated as forming the actuator for the switch 10. Lock plug 60 has a cylindrical sleeve portion 68 fixedly secured as part of the key lock tumbler plug 60. The push on fastener 34 is pressed over this sleeve portion 68 from the inside of base 40 with the spring teeth 36 of fastener 34 biting into the exterior of sleeve portion 68 to securely fasten the tumbler plug 60 and shell 56 to the base 40 in the positions as best seen in the sectional view of FIG. 2. With the subassembly of these parts 40, 56 and 60 completed the remainder of the switch component parts may be assembled with reference to terminal housing 12.

The key lock tumbler plug 60 has a drive shaft 70 extending axially therefrom. Shaft 70 passes through the central bore 22 of carrier 18. A key 72 projects radially outwardly and extends axially along the shaft 70. This key 72 engages within the keyway 24 of carrier 18 so that rotary movements may be imparted to carrier 18 by way of the shaft 70 and key 72 on the switch actuator provided by the key lock tumbler plug 60.

Returning to description of more specific details of the terminal housing 12, housing 12 has an exterior wall 80 defining therewithin a generally cylindrical cavity 82. Cavity 82 receives the carrier 18 which carries the pair of contactor discs 20 loosely received in the pockets 26 of carrier 18. When the housing 12 and base 40 are snapped together, utilizing the connecting means provided by the resiliently yieldable fingers 42 with their hooks 44, the housing and base effectively encloses the carrier 18 with its contactors 20 within cavity 82. At the same time, the circular curved spring 32 engaging against the flat annular surface 30 of carrier 18 with the opposite surface of spring 32 pressing against the continuous annular portion of press on fastener 34 biases the carrier 18 to urge the disc contactors 20 toward the contact portions of the terminals 14 and/or 16.

The exterior wall 80 of terminal housing 12 has a series of openings 84 formed in the wall, circumferentially spaced relative to the cavity 82. These openings 84 extend generally parallel to the axis of cavity 82. The openings 84 serve to receive the terminal portions of the terminals 14 and/or 16 that are assembled within the terminal housing 12 as will now be described.

Figure 4:
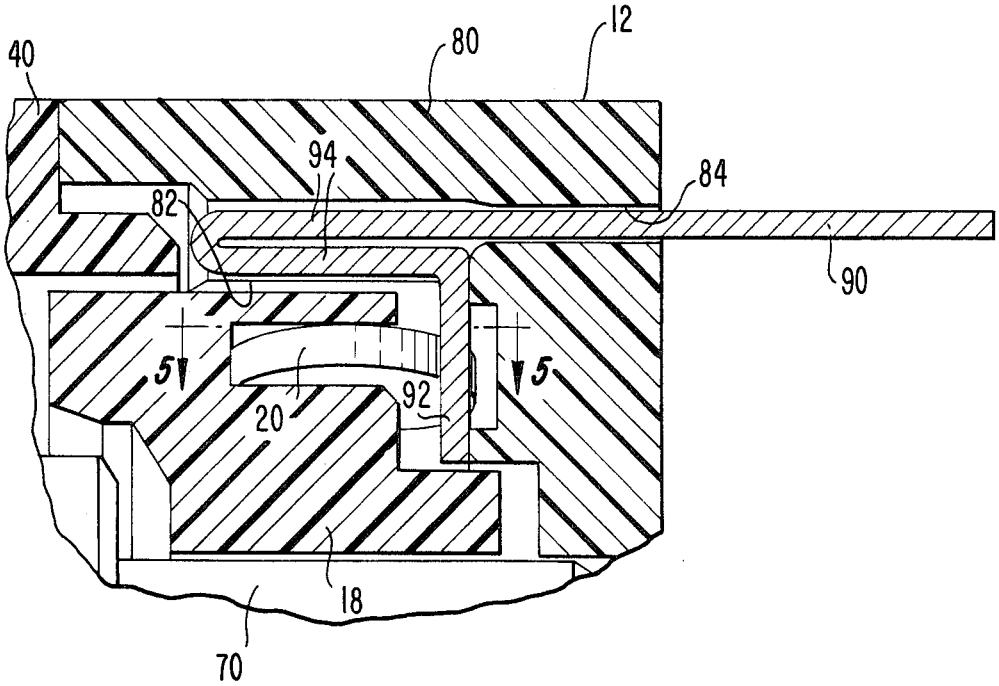
FIG. 4 is a sectional view taken on line 4—4 of FIG. 3.

Referring to FIG. 4, it will be seen that each terminal 14 and/or 16 has a terminal portion 90 and a contact portion 92. These portions are at opposite ends of each terminal 14 and/or 16. The terminal portion 90 of each terminal has a press fit engagement within one of the openings 84 so as to formally hold the terminal in place within the housing 12. The terminal portion 90 has an end exposed exteriorly of housing 12 for connection of the rotary switch 10 into a circuit to be controlled. A reversely bent section having two legs 94 disposed parallel to one another as shown on FIG. 4 lie in an extension of opening 84 to act as a guide in insuring firm upright holding of each terminal 14 and/or 16 within the housing 12 when the terminal portion 90 is pressed into an opening 84 in the exterior wall 80 of housing 12.

As has been previously mentioned, there are two differently configured terminals 14 and 16, each having a terminal portion 90 at one end thereof and a contact portion 92 at the opposite end thereof. Terminal 14 is a single terminal having a single contact area width for its contact portion 92. In contrast, terminal 16 is a double terminal having a pair of spaced single contact area widths 92. This pair of contact area widths are integrally connected by an intermediate contact area strip 96.

It will be noted that the contact portions 92 on the plurality of terminals mounted within housing 12 are disposed generally parallel with the bottom of cavity 82 in terminal housing 12, these contact portions being in a plane generally normal to the axis of the cavity 82.

Figure 3:
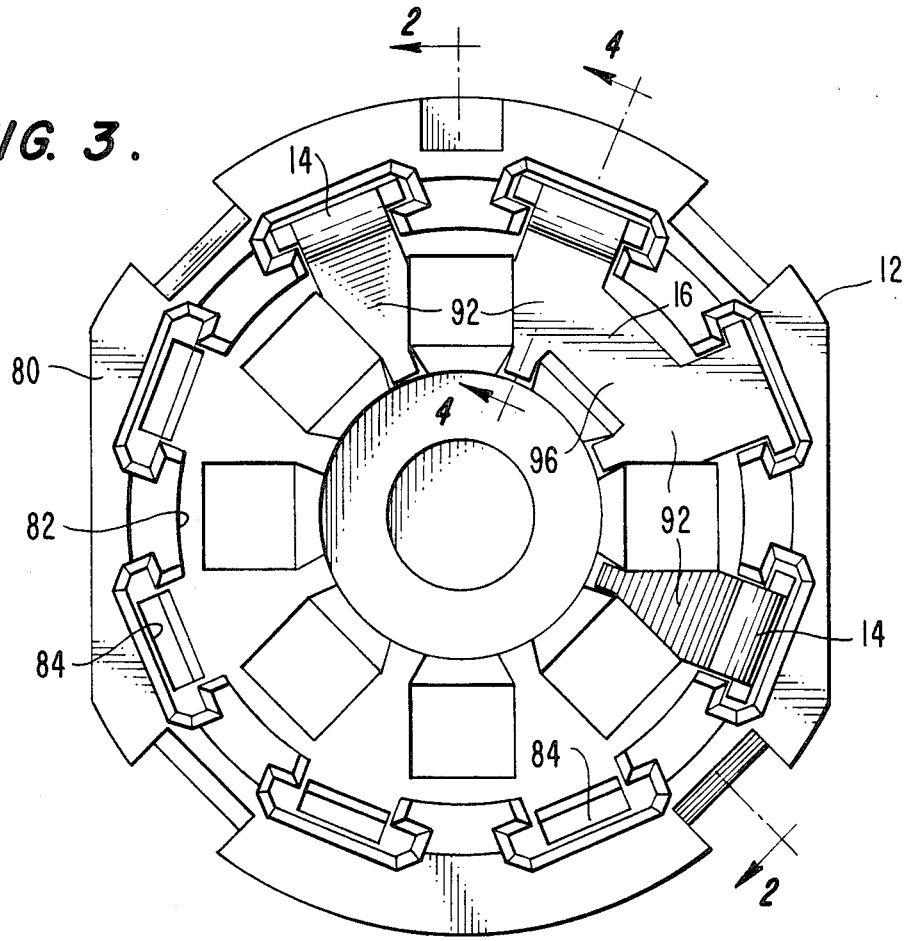
FIG. 3 is a plan view of the terminal housing for the rotary switch of FIG. 1 with selected terminals mounted therein.

The utilization of a combination of single and double terminals 14 and 16 may be easily visualized from the combination of terminals assembled in the terminal housing 12 as shown on FIG. 3. In this illustrated embodiment, a pair of single terminals 14 are pressed into appropriate openings 84 in the wall 80 of housing 12 with a double terminal 16 being mounted intermediate these two single terminals 14. It would thus be appreciated that when the carrier 18, having the contactor discs 20 loosely mounted in the pockets 26 of carrier 18, is rotated across the contact portions 92 of the terminals 14 and 16, one of the disc contactors 20 will detent between the straight contact edges of the adjacent contact portions on adjoining terminals within the housing 12. It is to be emphasized that as shown in FIG. 3, these straight contact edges of two adjacent contact portions 92 on adjoining terminals 14 and/or 16 are parallel to each other. This assures that the disc contactor 20 assumes a line contact with the adjacent edges of contact portions on adjoining terminals.

Figure 5:
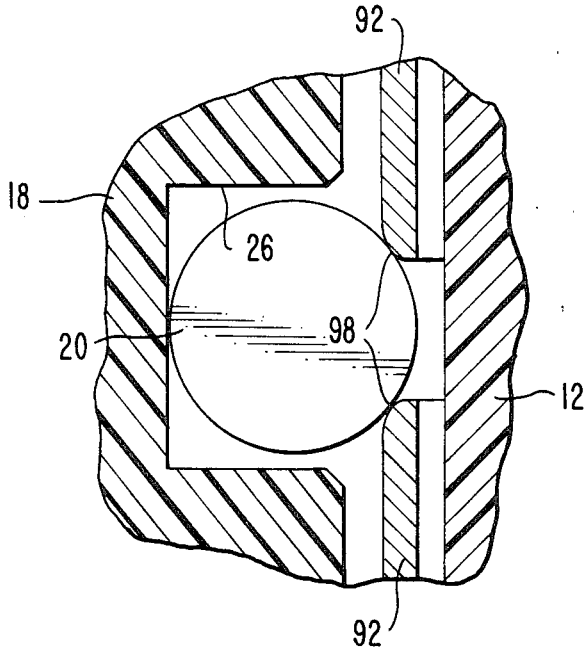
FIG. 5 is a sectional view taken on line 5—5 of FIG. 4 showing the relationship between the carrier, a disc contactor and adjacent contact portions on adjoining terminals.

As may be best seen from FIG. 5 the straight contact edges on each of the contact portions 92 are coined to thereby provide rounded edges 98 for engagement by the disc contactor 20 as shown in FIG. 5.

The arrangement of three terminals, two single terminals 14 and one double terminal 16 as shown on FIG. 3, provides a single pole switch operation with a detent holding effect between the straight contact edges of each of two adjacent contact portions on adjoining terminals and each detent effect occurring at 90° of rotation of carrier 18 using a single contactor disc 20. If this combination of two single terminals 14 and one double terminal 16 is repeated around the other half of the terminal housing 12 and a second disc contactor 20 is located in its pocket 26 of carrier 18, then a double pole switch configuration will be completed, again with detent at 0 and 90° or detent with each 90° of rotation of the carrier 18 holding the disc contactors 20.

Mentioning another form of terminal combination configuration, if single terminals 14 were to be mounted at each of the eight openings 84 in the terminal housing 12 and two disc contactors 20 employed in the pockets 26 of carrier 18, then the switch action would have a detent effect at every 45° of rotation of the switch actuator and a double pole switch configuration would be provided. As another example, if 90° rotation indexing is desired, the terminal arrangement shown in FIG. 3 would be utilized and duplicated on the other half side of the terminal housing 12 with two disc contactors 20 being employed to provide a double pole switch configuration.

Important features offering advantages in the rotary switch 10 of the invention are obtained by the fact that no secondary operations in assembly of the rotary switch such as staking, rivoting, heat joining of the plastic parts, etc. are required. The entire group of the component parts making up rotary switch 10 may be simple manually assembled with base 40 normally secured to the shell 56 which houses the key lock tumbler plug 60 by the annular press on fastener 34. Further, assembly of the component parts making up rotary switch 10 is advantageously completed by an "in line" assembly. In other words, the component parts as shown in the exploded view on FIG. 1 are simply axially assembled. Preloading of spring 32 inherently takes place when the hooks 44 on fingers 42 of base 40 are snapped over the bottom of the terminal housing 12.

Importantly, the shape of the contact portions of each terminal 14 and/or 16 when the terminals are mounted in the housing 12 provides straight parallel contact edges on the two adjacent contact portions of adjoining terminals. This allows the contactor disc 20 to rest against these parallel straight edges, giving line contact between the edges and the contactor 20 with the biasing force of spring 32 pressing carrier 18 and contactors 20 down to give a detent effect when the contactors 20 roll into the position of the contactor as shown on FIG. 5.

In connection with the switch operation, the disc contactor 20 tends to rotate as it climbs out of its location between two adjacent edges of adjoining terminals. It also rotates as it enters into the space between the edges of adjacent contact portions on adjoining terminals. On the other hand, as the contactor disc 20 moves across the surface area of each contact portion 92 or the area of an intermediate contact strip 96 with respect to the double terminal 16, a sliding action across the flat surface area is anticipated.

As has been mentioned above, the assembly of the component parts making up rotary switch 10 can easily be performed in an axial direction from one end to the other, thereby making for ease in utilizing automated assembly.

The construction of the rotary switch 10 may be described in summary as follows: a spring such as circular curve spring 32 bears against the insulated carrier 18 containing one or more disc contactors 20. The carrier 18 is keyed to the switch actuator to be capable of sliding up and down along the actuator shaft, a key lock tumbler plug 60 being shown in the illustrative embodiment as making up the actuator which rotates carrier 18. The disc contactor 20 is in contact with circumferentially spaced terminals 14 and/or 16, these terminals being pressed fitted into the series of openings 84 formed in the exterior wall 80, circumferentially spaced relative to the cavity 82 in terminal housing 12. The contactor discs 20 are capable of rotating out of and into recesses between the edges of adjacent contact portions 92 on adjoining terminals and sliding across the flat contact area of the terminals.

The detent action for the rotary switch 10 is created by the disc contactor 20 dropping between parallel edges of adjacent contact portions on adjoining terminals. The contact portions are specifically shaped and extend radially such that the edges of adjacent contact portions are parallel providing a line contact with the disc contactor rather than a point contact.

It should be obvious from the above described construction of the rotary switch embodiment that numerous other variations and modifications of the switch of this invention are possible, and such will readily occur to those skilled in the art. Accordingly, the scope of this invention is not to be limited by the embodiment disclosed, but is to include any such embodiments as may be encompassed within the scope of the claims appended hereto.

I claim:

1. A rotary switch comprising:

a terminal housing having an exterior wall defining a generally cylindrical cavity interiorly of said wall and a series of openings formed in said wall opening into said cavity circumferentially spaced relative to said cavity, said openings extending generally parallel to the axis of said cavity;

a plurality of terminals carried by said housing, each said terminal having a terminal portion extending through one of said openings with the terminal portion end exposed exteriorly of said housing for connection of said switch into a circuit to be controlled and a contact portion disposed generally parallel with the bottom of said cavity normal to said axis of said cavity;

a carrier rotatable within said cavity having at least one pocket formed therein facing said bottom of said cavity;

contactor means loosely received within said pocket to be freely movable therewithin;

a base having connecting means cooperable with said housing to connect said base and said housing together, thereby enclosing said carrier within said cavity;

spring means disposed to urge said contactor means toward said contact portions; and actuator means extending from the exterior of said switch through said base and drivingly engaged with said carrier to effect rotation of said contactor means relative to each of said contact portions and thereby operate said switch.

2. A rotary switch as recited in claim 1 wherein said pocket in said carrier is rectangular in cross section and said contactor means is a disc.

3. A rotary switch as recited in claim 2 wherein two of said pockets are formed in said carrier disposed on diametrically opposite sides of said axis of said cavity and said disc is loosely received in each of said pockets.

4. A rotary switch as recited in claim 1 wherein said spring means is a circular curved spring of flat resilient material.

5. A rotary switch as recited in claim 1 wherein said actuator means is provided by a key lock tumbler plug having the drive shaft thereof slidably keyed to said carrier to enable rotation of said carrier while allowing axial movement of said carrier within said cavity relative to said tumbler plug.

6. A rotary switch as recited in claim 1 wherein said spring means is disposed between said base and said carrier to urge said carrier and said contactor means toward said contact portions.

7. A rotary switch as recited in claim 1 wherein said connecting means on said base comprises resiliently yieldable fingers on said base, said fingers having hook means on the outer ends thereof engagable over the exterior of said terminal housing to hook beneath the end of said exterior wall.

8. A rotary switch as recited in claim 7 wherein said base is molded of plastic to provide said resiliently yieldable fingers and said fingers are received in grooves formed on the outer surface of said exterior wall parallel to said axis of said cavity.

9. A rotary switch as recited in any one of claims 1, 2, 3, 4, 5, 6 or 7 wherein said contact portion of each said terminal has a pair of straight contact edges and the contact edges of each of two adjacent contact portions on adjoining terminals are parallel, said contactor means engaging with the contact edges of said two adjacent contact portions during operation of said switch.

10. A rotary switch as recited in claim 9 wherein said contact edges are coined to provide rounded edges for engagement by said contactor means.

11. A rotary switch as recited in claim 9 wherein at least one of said terminals has its contact portion defined by a single contact area width extending radially inwardly from said terminal portion of said one terminal.

12. A rotary switch as recited in claim 9 wherein at least one of said terminals has its contact portion defined by a pair of spaced single contact area widths with each said width extending radially inwardly toward said axis of said cavity and an intermediate contact area strip integrally joining said pair of contact area widths.

* * * * *